US007726793B2

(12) United States Patent
Yamamoto

(10) Patent No.: US 7,726,793 B2
(45) Date of Patent: Jun. 1, 2010

(54) INK CONTAINER

(75) Inventor: Hajime Yamamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 342 days.

(21) Appl. No.: 11/898,388

(22) Filed: Sep. 12, 2007

(65) Prior Publication Data

US 2008/0012885 A1 Jan. 17, 2008

Related U.S. Application Data

(62) Division of application No. 11/140,917, filed on Jun. 1, 2005, now Pat. No. 7,293,850.

(30) Foreign Application Priority Data

Jun. 2, 2004 (JP) ..... 2004-164547

(51) Int. Cl.
*B41J 2/175* (2006.01)

(52) U.S. Cl. ..... 347/86

(58) Field of Classification Search ..... 347/7, 347/19, 86, 87
See application file for complete search history.

(56) References Cited

U.S. PATENT DOCUMENTS

| | | | | |
|---|---|---|---|---|
| 5,509,140 | A | 4/1996 | Koitabashi et al. | 347/86 |
| 6,012,794 | A | 1/2000 | Nakano et al. | 347/7 |
| 6,257,712 | B1 | 7/2001 | Haigo | 347/85 |
| 6,293,660 | B1 | 9/2001 | Kishida et al. | 347/86 |
| 6,921,161 | B2 | 7/2005 | Morita et al. | 347/86 |
| 7,137,688 | B1 | 11/2006 | Andersen et al. | 347/70 |
| 7,293,850 | B2 * | 11/2007 | Yamamoto | 347/7 |
| 2005/0270315 | A1 | 12/2005 | Yamamoto | |
| 2005/0270341 | A1 | 12/2005 | Yamamoto et al. | |
| 2005/0275698 | A1 | 12/2005 | Noguchi et al. | |

FOREIGN PATENT DOCUMENTS

| | | |
|---|---|---|
| EP | 338/5900 | 10/1989 |
| EP | 338590 | 10/1989 |
| EP | 1177904 | 2/2002 |
| EP | 1285764 | 2/2003 |
| EP | 1314565 | 5/2003 |

(Continued)

OTHER PUBLICATIONS

European Office Action dated Nov. 21, 2008 from corresponding European Application No. 05011841.3.

*Primary Examiner*—Anh T. N. Vo
(74) *Attorney, Agent, or Firm*—Fitzpatrick, Cella, Harper & Scinto

(57) ABSTRACT

An ink container includes an ink accommodation chamber for directly accommodating ink; a sensor portion for detecting a remaining amount of the ink in said ink accommodation chamber, wherein ambient air is introduced from an outside of said ink accommodation chamber into the ink in accordance with supplying the ink into an ink jet recording head; a division wall extended from an inner bottom portion of said ink accommodation chamber substantially upwardly, said division wall divides a space between an ambient air introducing portion which introduces the air into the ink in said ink accommodation chamber and said sensor portion to permit passage of the ink therethrough and to prevent passage, therethrough, of bubbles which are produced with introduction of the air.

3 Claims, 13 Drawing Sheets

FOREIGN PATENT DOCUMENTS

| | | |
|---|---|---|
| JP | 5-96744 | 4/1993 |
| JP | 9-254405 | 9/1997 |
| JP | 10-232157 | 9/1998 |
| JP | 2951818 | 7/1999 |
| JP | 2003-237097 | 8/2003 |
| JP | 2003-326731 | 11/2003 |
| JP | 2003-334970 | 11/2003 |
| JP | 2004-142326 | 5/2004 |

* cited by examiner

INK CONTAINER

This application is a division of application Ser. No. 11/140,917, filed Jun. 1, 2005 now U.S. Pat. No. 7,293,850, the contents of which are incorporated herein by reference.

FIELD OF THE INVENTION AND RELATED ART

The present invention relates to an ink container for accommodating ink to be supplied to an ink jet recording head, and an ink jet recording apparatus usable with an ink container.

A detection of remaining ink amount will first be described.

An ink container used with a field of an ink jet recording has a limited ink accommodation capacity to continuously supplying the ink to a recording head for ejecting the ink, and is detachably mountable to a recording device. When the ink is used out of the ink container is exchanged with a fresh ink container, and the ink supply is possible until the lifetime of the recording device (recording head) ends.

In order to detect the short of the ink in the ink container, various structures have been proposed and are put into practice. More particularly, there are a method in which an electric conductivity of the ink is used to detect whether or not the ink level (height of the ink liquid surface) is enough, a method in which a refractive index difference between the space containing the ink and the space without the ink with the use of a reflection prism of a material having a refractive index relatively close to the refractive index of the ink to detect whether or not the ink level (height of the ink liquid surface) is enough, a method in which an electrostatic capacity between the ink and the electrode between is used to detect whether or not the ink level (height of the ink liquid surface is enough, and so on. One of these methods may be additionally used to detect the ink level in a multi-stage fashion, or some of these methods are combined. The method may be combined with another method called "dot count method" wherein the remaining ink amount is calculated on the basis of ink ejection amount or the like.

The ink accommodation technique for retaining the ink in an ink container will be described.

An ink container (liquid container) used in the field of ink jet recording is provided with a structure for adjusting a retaining force for retaining the ink in the ink cartridge to accomplish enough ink supply to the recording head which ejects the ink. The retaining force provides a negative pressure to retain the pressure at the ink ejection portion of the recording head at a negative level relative to the ambient pressure. In a known ink container, for easy manipulation of the ink container including mounting and demounting thereof relative to the recording device, the ink is accommodated directly (i.e., without a negative pressure producing material) in a hard case to enhance the ink accommodation efficiency, and the air (ambience) is introduced into the ink accommodation chamber which directly accommodates the ink, from the outside of the ink container, correspondingly to the ink supply-out of the ink during the process of using the ink up, so that ink accommodated in the container, while preventing the pressure from exceeding the suitable positive and negative pressure range (too high pressure) during the ink supply operation of the recording head. Referring first to FIGS. 11 and 12, there is shown an example of an ink container of such a structure. With the ink container 1001 of FIG. 11, the ink is directly accommodated in the container, and the air is at the upper part space 1009 in the container, and a bottom surface of the container is provided with an ink supply port 1003 and an ambience introducing portion. The air introducing portion is constituted by a hole 1004 in the outer surface of the container, a holes 1006 in an inside surface of the container, and a meandering fluid communication path 1005 for interconnecting the hole 1006 and the hole 1004 extending through the wall. With such a structure, bubbles 1007 are introduced into the upper space 1009 so as to maintain the suitable positive and negative pressure in the container from the said air introducing portion with the lowering of a gas-liquid interface 1008 as a result of supply of the ink out of the container through the ink supply port 1003 into the ink jet recording head (unshown). On the other hand, in the ink container 1011 shown in FIG. 12 (Japanese Laid-open Patent Application Hei 5-96744), the ink 1012 is directly accommodated therein, wherein the upper space 1019 of the container is filled with the air, and the bottom surface of the container is provided with fluid-communication members 1022, 1023 having different lengths. When the ink container 1011 is mounted to an ink receiving portion 1021 of an unshown ink jet recording head, the ink 1024 is supplied through the fluid-communication member 1022 into the ink receiving chamber provided in the ink receiving portion 1021. Correspondingly, the gas-liquid interface 1018 in the container lowers, and the air 1025 existing at an upper part of the ink receiving portion chamber is introduced in the form of bubbles 1017 toward the upper space 1019 through the communicating portion 1023, so as to maintain a proper negative pressure in the container. When the ink level in the ink receiving chamber reaches the bottom end portion of the fluid communication path 1023, the ink supply stops.

A structure in which the ambience is introduced into the ink accommodation chamber through the negative pressure generating member accommodating chamber which accommodates the negative pressure generating member, as is different from FIGS. 11 and 12 in the operation principle, is known (Japanese patent No. 2951818 (U.S. Pat. No. 5,509,140), FIG. 13, which will be described hereinafter).

As described in the foregoing, it is known to directly accommodate the ink and to introduce the ambient air from the outside to maintain the proper negative pressure. It is also known to provide the inside of the accommodation chamber for accommodating the ink directly with an optical reflection structure at the bottom side or the portion adjacent thereto, as disclosed in Japanese patent No. 2951818 (U.S. Pat. No. 5,509,140.

This patent will further be described.

The assignee has proposed in Japanese Patent No. 2951818 (U.S. Pat. No. 5,509,140) and so on, an ink container having an ink accommodation chamber which uses an ink negative pressure generating member and which still has a relatively larger ink accommodation capacity per unit volume of an ink container with the capability of stabilized ink supply.

FIG. 13, (*a*), is a substantial sectional view of an ink container 1031 of such a structure. The inside of the ink container 1031 is partitioned into two spaces by a partition wall 1040 having a communicating portion 1036. One of the spaces, is hermetically sealed except for the communicating portion 1036 of the partition wall 1040, and constitutes an ink accommodation chamber 1031*a* (reservoir) which directly accommodates the ink 1032, and the other space is a negative pressure generating member accommodating chamber 1031*b* for accommodating the negative pressure generating member 1035. The wall surface defining the negative pressure generating member accommodating chamber 1031*b* is provided with an air vent 1034 for introduction of the ambient air into the ink container 1031 in accordance with consumption of the ink and is also provided with an ink supply port 1033 for supplying the ink into a recording head portion (unshown). In FIG. 13, (*a*), such a region in the negative pressure generating member 1035 as retains the ink is indicated by hatching (portion 1039).

With the above-described structure, when the gas-liquid interface 1038 in the negative pressure generating member 1035 lowers and reaches the level shown in FIG. 13, (*a*) with consumption of the ink of the unshown recording head, the air 1037 is introduced into the negative-pressure generating member accommodating chamber 1031*b* through the air vent 1034 with the subsequent consumption of the ink, and the air enters the ink accommodation chamber 1031*a* through the communicating portion 1036 of the partition wall 1040. In exchange, the ink is supplied from the ink accommodation chamber 1031*a* into the negative pressure generating member 1035 in the negative pressure generating member accommodating chamber 1031*b* through the communicating portion 1036 of the partition wall (gas-liquid exchanging operation). In this manner, when the ink is consumption by the recording head, the corresponding amount of the ink is supplied into the negative pressure generating member 1035 so that negative pressure generating member 1035 retains a predetermined amount of the ink (that is, maintains the predetermined level of the gas-liquid interface 1038), by which the negative pressure of the ink to be supplied to the recording head is maintained substantially constant, thus accomplishing a stabilized ink supply to the recording head.

In the example of FIG. 13, (*a*), a gas introduction groove 1040*a* is provided in the neighborhood of the communicating portion 1036 between the ink accommodation chamber 1031*a* and the generating member accommodating chamber 1031*b* to promote ambient air introduction, and on the other hand, a space (buffer chamber) 1054 which is substantially free of the negative pressure generating member 1035 is provided in the neighborhood of the air vent 1034.

The example shown in FIG. 13, (*b*), is similar, wherein the container comprises a partition wall 1050 for partitioning the inside space of the ink container 1041 into the ink accommodation chamber 1041*a* and the negative pressure generating member accommodating chamber 1041*b*, a communicating portion 1044 disposed in the neighborhood thereto, a gas introduction groove 1050*a*, an ink supply port 1043, an air vent 1044 and a negative pressure generating member 1045 and so on. In the neighborhood of the air vent 1044, a rib 1052 is projected to provide the space (buffer chamber) 1053 which is free of the negative pressure generating member 1035.

The bottom surface of the ink accommodation chamber 1041*a* of the ink container 1041 is provided with an optical reflection member 1051 having a triangle prism configuration integrally molded with the casing defining the inside space of the ink container 1041, and the two reflecting surfaces form 90°at the apex line therebetween). At such a portion of the main assembly as is below the optical reflection member 1051, there is provided an optical sensor (unshown) including a light emitting portion and a light receiving portion. The light is emitted from the light emitting portion to a bottom surface of the optical reflection member 1051 and is reflected by the two reflecting surfaces of the optical reflection member 1051. On the basis of the light quantity received by the light receiving portion of the optical sensor, the presence and absence of the ink in the ink accommodation chamber 1041*a* at the level of the optical reflection member 1051 is detected (remaining ink amount detection).

Such downsized and high efficiency ink cartridges or containers have been commercialized and used in these days.

With the above-described structure, the remaining ink amount can be simply and easily detected by the optical reflection member which is effective to detect that ink exists up to the level of the optical structure provided in the accommodation chamber directly (substantially without the negative pressure generating material or the like) accommodates the ink. Recently, however, the recording speed of the ink jet recording apparatus is raised because of the increase of the number of the ejection nozzles and the increase of the ink ejection frequency, which leads to increased ink supply amount from the ink container to the recording head per unit time. In addition, the frequency of continuous printing of photographic image quality print increases, because photographic image which requires ink supply for the entire area of a sheet unlike the case of printing characters, patterns or tables, are increasingly frequently printed (for example, the images photographed by digital cameras). In addition, such images are continuously printed frequently. As a result, the ink consumption amount per ejection nozzle (printing duty) remarkably rises, and the continuous high duty printing operations are required.

It has been found that with such tendencies, a new problem not recognized with the above-described ink container arises in some cases. The problem will be described.

The ambient air introduced into the ink accommodation chamber by the gas-liquid exchange becomes air bubbles and rises upwardly toward the ink liquid surface as indicated by bubbles 1047 in FIG. 13, (*b*), and the bubbles on the liquid surface lowers with the lowering of the liquid surface until the bubbles disappear. The time until the bubbles disappear is dependent upon the ink properties and the ambient conditions. When the bubbles lower to the detection level equal to the level of the position of the optical reflection member, the detector discriminates the presence of the ink at the level until the bubbles around the optical reflection member disappear, despite the event that actual ink level is lower than that.

When the absence of the ink is first detected, the detection result does not meet the actual ink accommodation state (accommodation capacity), with the result that ink has already been not suppliable upon the ink short is first detected. With the above-described recent tendency toward the high speed printing, the increase of the ink supply flow rate per unit time cannot afford the time duration until the disappearance of the bubbles in some cases.

Furthermore, in order for the ink to be absorbed into the sheet of the drawing at a high speed, some ink contains a surfactant to enhance the perviousness into the recording paper, and in such a case, the bubble generation tendency is relatively higher, and the time required for the bubbles to disappear is relatively longer. Moreover, in the case of a printer using independent containers arranged in a line to produce different colors, the ink containers have small widths (measured in the direction of the arrangement) in many cases. In such a case, the distances between the optical reflection member of the triangle prism configuration on the inner bottom portion of the accommodation chamber and the inner side walls of the ink accommodation chamber, are small, and therefore, the bubbles do not easily disappear.

For example, the remainder amount of the ink in the ink accommodation chamber reduces to slightly above the optical reflection member in the ink accommodation chamber. In such a state, if the ink supply amount per unit time to the recording head is quite larger than the conventional supply amount, that situation arises. This is the same when the ink supply amount to the recording head is quite larger than the conventional supply amount irrespective of the remaining amount of the ink in the ink accommodation chamber.

In such a case, in the process of upward movement of the air bubbles, the bubbles concentrate around the optical reflection member with the result of obstruction to the normal detection, or the bubbles rise up to the ink liquid surface but lower with the lowering of the ink liquid surface with the consumption of the ink, with the result of concentration around the optical reflection member.

Referring to FIG. 14 and FIG. 15, the behavior of the bubbles will be described.

FIG. 14 shows a typical arrangement of a conventional ink jet recording apparatus and an ink container, wherein (a) schematically shows a state of gas-liquid exchanging process (the gas-liquid interface is indicated by 1062*a*) in the case that ink supply amount q per unit time (μl/s or ml/min) is relatively low as when the characters and/or tables are printed. Since the ink supply amount per unit time is small, the amount of produced bubbles 1067 is small, and the number of the prints is not very large, the amount of the total bubbles produces is not very large, either.

Therefore, the bubbles 1067 disappear before the next printing operation (the time interval is 5 mins., 1 hour or 3 days usually), as shown in FIG. 14, (*b*), so that there occurs no malfunction of the optical reflection member (prism), namely, the erroneous detection of the optical sensor 1071 of the detecting means (including the light emitting portion 1072 and the light receiving portion 1073) provided in the recording device.

When the ink liquid surface in the ink accommodation chamber is so low that it is above but adjacent to the optical reflection member 1070, as shown in FIG. 14, (*c*), wherein the level of the ink is indicated by reference numeral 1061*c*), the bubbles 1074 introduced into the ink accommodation chamber through the communicating portion 1044 substantially stagnate around the optical reflection member 1070 until they rise in the ink to above the ink liquid surface 1061*c* or to immediately below it, where they disappear.

Even if the bubbles 1075, when the ink accommodation chamber reaching empty (that is, the very moment when the correct detection is required, stick to the reflecting surfaces of the optical reflection member at the side contacting the ink, as shown in FIG. 15, (*a*) so that part of the light emitted from the main assembly side of the printer is not reflected but refracted and transmitted with the result of erroneous detection of the presence of the ink, the time interval to the next printing time from the state of FIG. 15, (*a*), is enough for the bubbles to disappear, in the conventional printing scheme. Therefore, there arises no practical problem by the restoration to the normal state shown in FIG. 15, (*b*).

On the other hand, even if the presence of the ink is erroneously detected with the state of FIG. 15, (*a*), the amount of the ink which would be supplied until the state of FIG. 15, (*b*) occurs would be very small, and therefore, even if the detection of the shortage of the ink is delayed, the supply amount is small, and the continuous printing is seldom, and therefore, the gas-liquid interface lowers to the level indicated by reference numeral 1062*e* in FIG. 15, (*b*) at worst. For this reason, the deviation (for example, 0.1-0.2 g) of detection is not a problem in terms of the ultimate object of the remaining amount detection function (the detection of emptiness).

In this example of the ink container, the amount of the ink which is retained in the negative pressure generating member below the gas-liquid interface 1062*a* shown in FIG. 15 and which can be supplied out, is approx. 3 g.

With ordinary ink, the amount of the ink required to print a solid image on an A4 size sheet at the maximum image density is approx. 1 g in consideration of the proper coloring density and the bleeding. In the case of an ordinary text document, the print ratio is 5% (approx. 0.05 g) or 7.5% (approx. 0.075 g), and said deviation amount is sufficiently small, from the practical standpoint.

In the case of FIG. 16 illustrating the problem underlying the present invention, the amount of the ink supplied per unit time is large as shown in FIG. 16, (*a*), and therefore, the amount of the bubbles 1081 introduced into the ink per unit time and the absolute amount of the bubbles 1082 stagnating above the ink liquid surface are both remarkably large. In addition, since the ink supply amount is large, the bubbles quickly lowers with the ink liquid surface 1061*a* in the ink accommodation chamber, as shown in FIG. 16, (*b*) to the extent indicated by reference numeral 1061*b* where the bubbles are at the level indicated by the reference numeral 1083, and the ink may be continue to supply out without enough time to recover the normally detectable state.

More particularly, with the state of FIG. 16, (*c*), the ink in the ink accommodation chamber is completely used up, but the bubbles having lowered with the lowering of the ink liquid surface 1061*b* covers the reflecting surfaces of the optical reflection member so that emitted light escapes through the thin layers of the ink constituting the bubbles with the result of incapability of returning of the light to the light receiving portion. Thus, the optical sensor 1071 (detecting means in the recording device side) erroneously detects the presence of the ink. That is, the emptiness of the ink accommodation chamber is not correctly detected. If the ink supply continues, the erroneous remaining amount detection, that is, the deviation from the remainder ink amount indicated by the reference numeral 1090 in FIG. 16, (*d*), is significant when the printing duty is high despite the printing period is 1 min. or the printing amount is 2-3 pages.

The result may be that ink becomes actually short, and the faint or scratchy print is produced, before the final ink shortage is warned. If this occurs in the case of printing on expensive sheet for printing a photograph, the waste of the sheet and waste of time are significant, and in addition, the additional operation for removing the air from the recording head is required to recover the normal printing operation.

SUMMARY OF THE INVENTION

Accordingly, it is a principal object of the present invention to provide an ink container wherein an optical reflection member is provided in an accommodation chamber for directly accommodating the ink to detect the remaining ink amount, and wherein the ambient air is take-in into the accommodation chamber from the outside by gas-liquid exchanging operation or the like in accordance with the ink supply operation, and the, wherein erroneous detection of the remaining ink is suppressed.

It is added that ink container wherein the air ultimately existing above the ink in the ink accommodation chamber is introduced not through the ink does not involve the problem underlying the present invention.

FIG. 17 show such an example, wherein the ink 1102 is directly accommodated in the ink container 1101, and the air stagnates in the top space 1107. The bottom surface of the container is provided with an ink supply port 1103 closed by a plug urged by an elastic member. The upper portion of the provision is provided with an air introducing portion 1104 for introducing the ambient air from the outside. With the supply of the ink 1102 from the ink supply port into the ink jet recording head, the gas-liquid interface 1106 lowers, and correspondingly, the air is introduced into the top space 1107 through the air introducing portion 1104.

The problem arising from a droplet of ink remaining on the reflecting surface with the result of malfunction is known, but the problem arising from the relationship between the bubbles and the optical reflection member in an ink container wherein gas-liquid exchanging operation occurs is not known.

According to an aspect of the present invention, there is provided an ink container comprising an ink accommodation chamber for directly accommodating ink; a sensor portion for detecting a remaining amount of the ink in said ink accommodation chamber, wherein ambient air is introduced from an outside of said ink accommodation chamber into the ink in accordance with supplying the ink into an ink jet recording head; a division wall extended from an inner bottom portion of said ink accommodation chamber substantially upwardly, said division wall divides a space between an ambient air introducing portion which introduces the air into the ink in said ink accommodation chamber and said sensor portion to permit passage of the ink therethrough and to prevent passage, therethrough, of bubbles which are produced with introduction of the air. With such a structure, the bubbles produced by the gas-liquid exchange are substantially prevented from entering the section in which the sensor portion is provided in the ink accommodation chamber by the division wall. Therefore, the ink supply can be stabilized even when the printing speed is increased or the ink supply amount is increased in ink jet recording, and the delay in the remaining ink amount detection in the case of using the sensor portion can be avoided.

According to an aspect of the embodiment of the present invention, the provision of the division wall substrate between the sensor portion and the ambient air introducing portion in the ink accommodation chamber, is effective to substantially prevent the air bubbles from approaching to the sensor portion for detecting the remaining ink amount, thus quickly directing the bubbles upward from the bottom surface of the ink accommodation chamber, and/or substantially prevent the air bubbles from lowering with the lowering of the ink liquid surface. Thus, even if the continuous print with high printing duty is carried out, the erroneous detection of the remaining ink amount can be effectively prevented, thus accomplishing a highly reliable ink container.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Referring to the accompanying drawings, the preferred embodiment of the present invention will be described.

Figure 1:
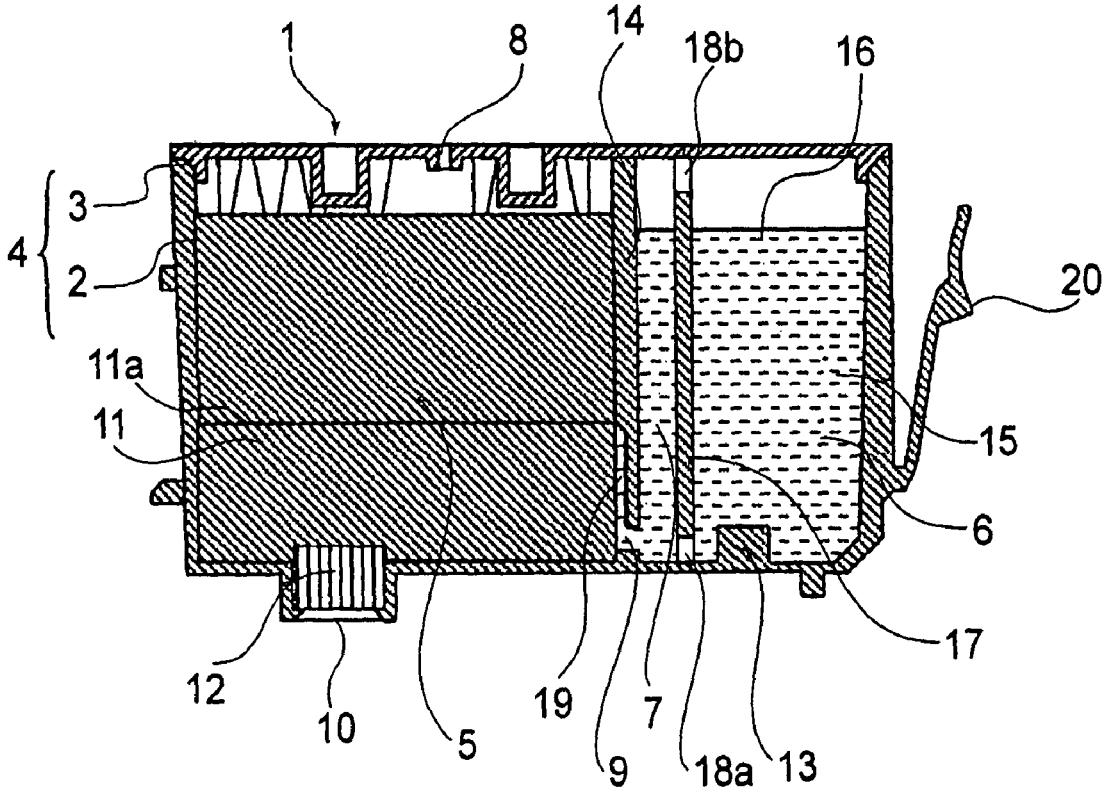
FIG. 1 is a schematic sectional view illustrating an ink container according to Embodiment 1 of the present invention.

FIG. 1 shows an ink container according to an embodiment of the present invention. The inside of the ink container 1 is partitioned by a partition wall 14 into independent two spaces or chambers which are in fluid communication with each other through a communicating portion 9 provided at a lower portion. One of them is a negative pressure generating member accommodating chamber 5 accommodating a negative pressure generating member 11 and is provided with an air vent 8 and an ink supply port 10; and the other is an ink accommodation chamber 6 for accommodating directly the ink.

In the ink accommodation chamber 6, there is provided a division wall 17. The division wall 17 has one side which is faced toward the communicating portion 9 through which the gas (air) is introduced and another side is faced toward an optical reflection member 13 (optical structure) for detecting the remaining ink amount.

When the ink container 1 is mounted in the printer, and the ink supply is carried out to the ink jet recording head (unshown) through the ink supply port 10, the ink in the negative pressure generating member accommodating chamber 5 is supplied out to such an extent that ink level lowers to the position indicated by reference numeral 11*a*, namely, the upper end level of a gas introduction groove 19. Thereafter, the ambient air is introduced in the form of bubbles into the ink accommodation chamber 6 through the gas introduction groove 19 and the communicating portion 9, and correspondingly, the ink 15 is supplied into the negative pressure generating member 11 through the fluid communication path 9 from the ink accommodation chamber 6. During such a gas-liquid exchange process in which the ink 15 in the ink accommodation chamber 6 is consumed, the ink liquid surface in the negative pressure generating member 11 is maintained substantially at the position 11*a*.

With this structure, the provision of the division wall 17 functions as means (A), provided between the optical reflection member 13 and the communicating portion 9, for quickly directing the bubbles produced by the gas-liquid exchange and moving upwardly, toward the top without approaching to the optical reflection member 13 for detecting the remaining ink amount.

The division wall 17 is adjacent to the partition wall 14 but away from the partition wall 14 by a distance enough not to obstruct rising of the bubbles and is extended to the neighborhood of a ceiling of the ink accommodation chamber 6, thus functions as means (B) for guiding the bubbles upwardly in the ink accommodation chamber.

At the position adjacent to the means for guiding the bubbles, more particularly, at the top end portion of the division wall 17 in this embodiment, there is provided means (C) for suppressing lowering of the bubble with the lowering of the ink liquid surface. The means (C) in the form of projections or the like for stagnating the bubbles, will be described hereinafter in conjunction with FIG. 3. Therefore, the time duration can be afforded until bubble disappearance. Thus, a simple ink container can be provided wherein the erroneous detection of the remaining ink amount using a prism attributable to the bubbles lowered with the ink liquid surface can be avoided even when the continuous printing is carried out with high ink supply flow rate as well as when the intermittent printing with low speed as in the conventional case.

Embodiments

The description will be made as to the embodiments in conjunction with the accompanying drawings. In the following descriptions, the reference is made to ink as the liquid usable with the liquid supply method and the liquid supplying system of the present invention, but the present invention is not limited to the use with the ink, but is applicable to so-called processing liquid to be applied to the recording material, or the like, in the field of ink jet recording.

The present invention is applicable to the structure wherein the ambient air is introduced in the form of bubbles to control the negative pressure in the ink accommodation chamber for accommodating the ink, as in the structure wherein the negative pressure generating member accommodating chamber and the ink accommodation chamber are partitioned by a partition wall, and these chambers are in fluid communication with each other only through the opening provided at the lower portion of the partition wall. The present invention is not limited to the structures having such a negative pressure generating member accommodation chamber or the structure having the partition wall. In the drawings referred to in the following descriptions, there are shown states in which the ink in the negative pressure generating member has been consumed to such an extent that ink in the ink accommodation chamber is consumed (that is, the gas-liquid exchange occurs).

Embodiment 1

FIG. 1 is a schematic sectional view of the ink container 1 according to Embodiment 1 of the present invention. In FIG. 1, the ink container 1 comprises a case 2 which opens at the upper portion, and a cap 3 covering the negative pressure generating member accommodating chamber 5 and the ink accommodation chamber 6. The partition wall 14 partitions the ink container into a negative pressure generating member accommodating chamber 5 which accommodates the negative pressure generating member 11, is in fluid communication with the ambient air at the upper portion and is in fluid communication with the ink supply port 10 at the lower portion, and the ink accommodation chamber 6 substantially hermetically sealed and accommodating the ink 15. The lower portion of the partition wall 14 is provided with a communicating portion 9 (opening) for permitting fluid communication between the negative pressure generating member accommodating chamber 5 and the ink accommodation chamber 6.

The bottom surface of the ink accommodation chamber 6 is provided with an optical reflection member 13 in the form of a triangle prism having two reflecting surfaces forming substantially 90° at the apex. The optical reflection member 13 is integrally formed with the case 2. The division wall 17 (structural member) substantially separates the optical reflection member 13 side and the fluid communication path 9 side in the ink accommodation chamber 6, and extends from a neighborhood of the bottom portion of the ink accommodation chamber 6 to a neighborhood of the upper cap 3. Thus, the division wall 17 provides a section 7 (middle chamber) at the fluid communication path 9 side of the ink reservoir chamber 6.

Figure 2:
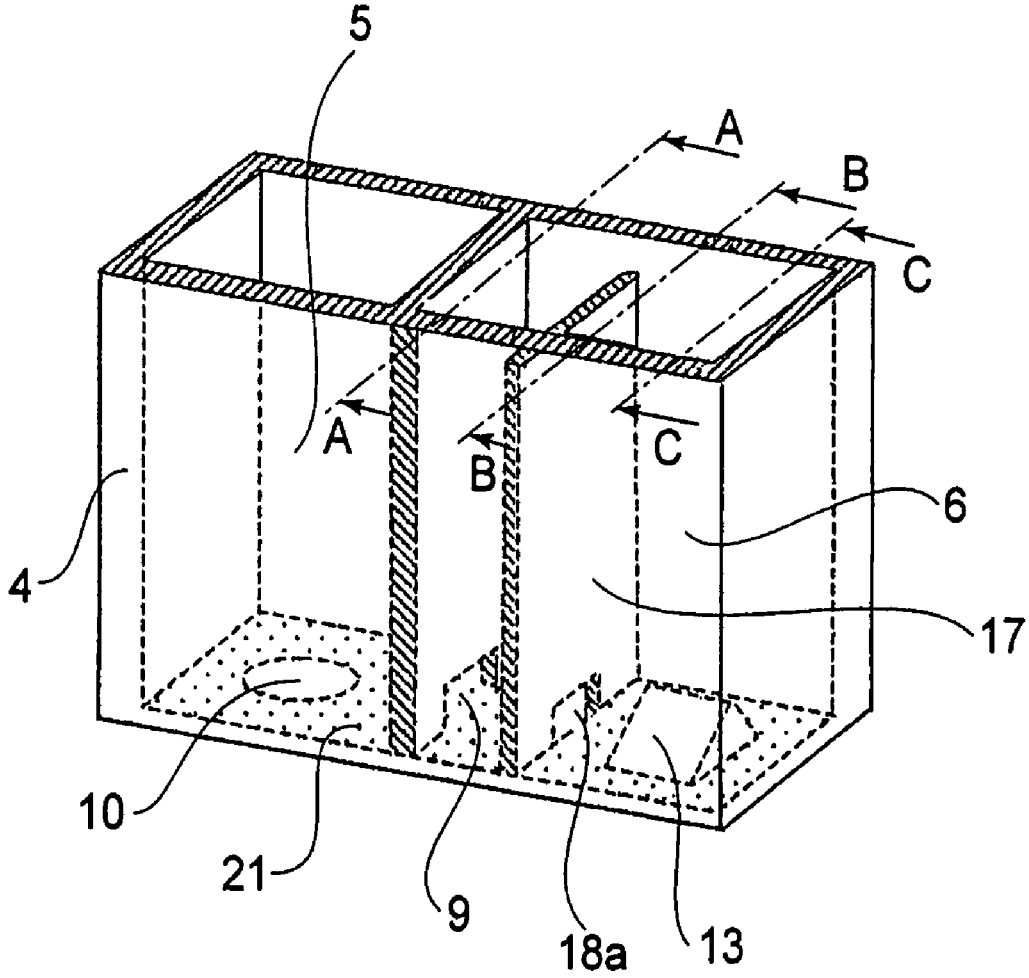
FIG. 2 is a perspective view illustrating an inside structure of the ink container according to Embodiment 1.
Figure 3:
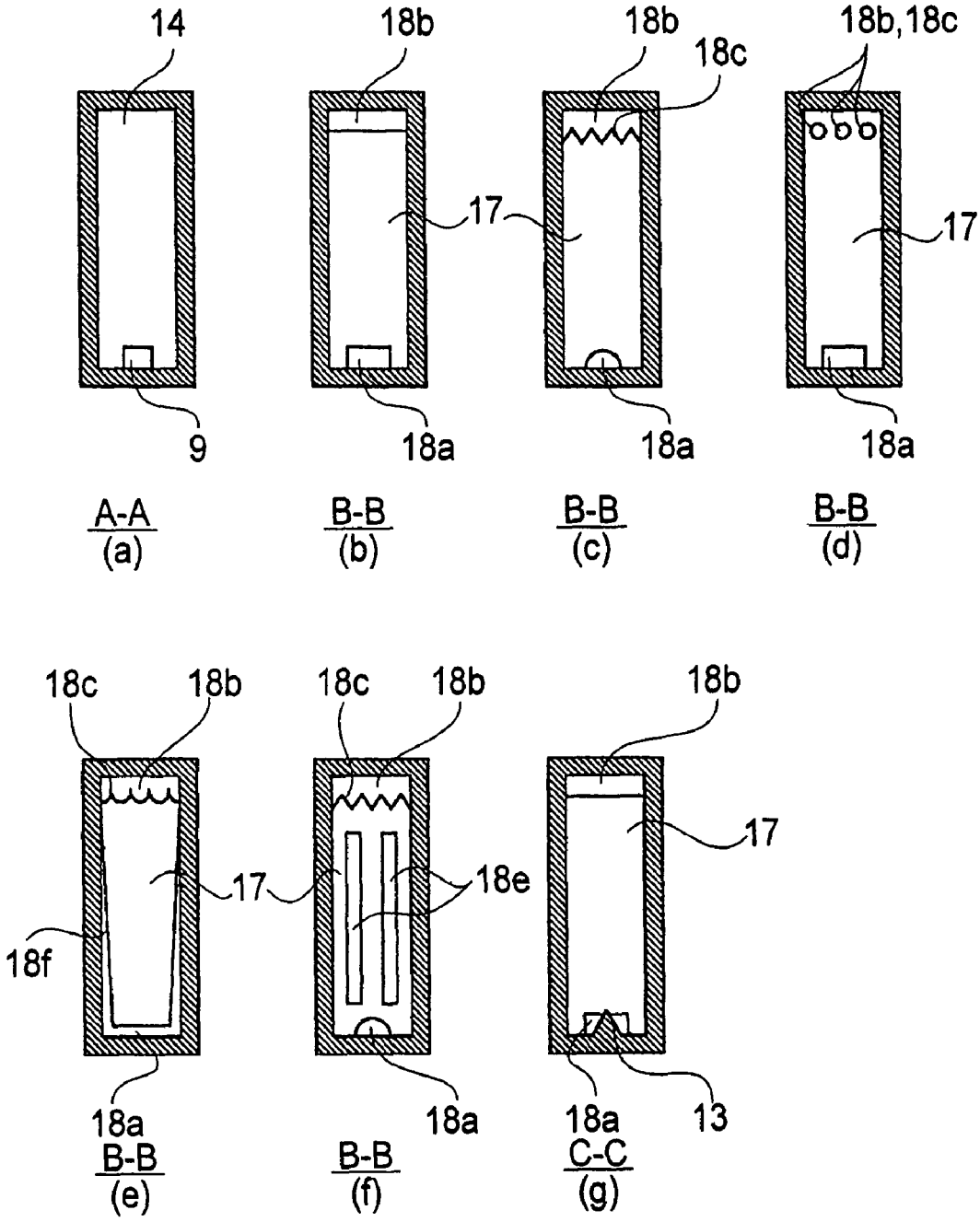
FIG. 3 is a sectional view illustrating a modified example, according to the present invention, of Embodiment 1.

In the lower portion of the division wall 17, there is an opening 18*a* having a size to permit the ink in the section to smoothly move into the negative pressure generating member 11 through the fluid communication path 9 without remaining in the section and to prevent the bubbles coming from the fluid communication path 9 from entering toward the optical reflection member. At the upper portion of the division wall 17, there is an opening 18*b* for fluid communication between the chambers sandwiching the division wall 17 (the ink accommodation chamber 6 having the optical reflection member 13 and the chamber 7) to make the ink levels of the chambers equal to each other without bubbling at the bottom opening 18*a*. FIG. 2 is a perspective schematic perspective view of the ink container of Embodiment 1. FIG. 3, (*a*)-(*g*) are sectional views taken along A-A, B-B and C-C of FIG. 2, respectively.

In FIG. 3, (*a*), there are shown a partition wall partitioning between the ink accommodation chamber 6 and the negative pressure generating member accommodating chamber 5, and the communicating portion 9 for exchange of the ink and the ambient air. FIG. 3, (*g*) shows the optical reflection member provided at the bottom portion of the ink accommodation chamber 6, the division wall 17 for providing the middle chamber 7, and the openings 18*b*, and 18*a* formed at the upper portion and the lower portion.

FIG. 3, (*b*)-(*f*), show a structure for stagnating the bubbles rising between the partition wall 14 and the division wall 17 and for preventing the bubbles entering the other side (the ink accommodation chamber 6 portion having the optical reflection member).

As shown in FIG. 3, (*c*), the opening 18*b* formed between the ceiling of the ink accommodation chamber 6 and the top end portion of the division wall 17 is shown, wherein the opening 18*b*, more particularly the top end portion 18*c* of the division wall 17 in this embodiment, has a triangular saw teeth configuration to impede passage of the bubble. By this, the circumferential length of the opening is long while assuring a sufficient opening area, and therefore, the bubbles, even if the amount thereof is large, are effectively trapped there, so that long time period for the bubble disappearance is provided and so that bubbles are positively vanished. The opening 18*a* is sized and positioned not to provide a pressure difference between the chambers sandwiching the division wall 17 by completely trapping the bubbles to provide a large meniscus force, and therefore, the same levels are assured in the chambers sandwiching the division wall 17.

FIG. 3, the structure shown by (*d*) is different in that plurality of the openings are provided, and the opening is disposed at a position slightly lower than the ceiling in consideration of the fact that bubbles tend to be trapped at the ceiling and/or the apex configuration portions, but the effects of the present invention are the same.

FIG. 3, (*e*) shows a modified example of the configuration of the top end portion 18*c* of the division wall 17 forming the opening 18*b*. It is not inevitable to form the division wall 17 integrally with the ink container body 2. For example, a separate member may be inserted through the opening of the container. In such a case, it is not necessary to completely closely contact the separate member to the inner surface of the wall of the ink accommodation chamber 6 except for the openings 18*a*, 18*b*. A partial press-fitting structure is usable, with a gap or gaps formed as long as the effect of the present invention is provided. Is such a case, if the gap is small enough to prevent passing of the bubbles, the edge line or lines of the partition 17 can function to trap the bubbles. The bubble is an air bubble, and therefore, it does not disappear unless it reaches the ink liquid surface. However, if it is temporarily trapped, it rises with time so that production of the bubbles corresponding to the ink supply amounts can be made uniform.

In FIG. 3, (*f*) shows a modified example of the structure of FIG. 3(*e*), wherein designated by reference numeral 18*e* are fine openings in the form of slits formed in the division wall 17.

As described in the foregoing, the lower portion of the division wall 17 quickly directs the bubbles upward to prevent the bubbles from approaching to the optical reflection member, and the entirety of the division wall 17 guides the bubbles upward in the middle chamber 7 provided in the ink accommodation chamber, and at the upper portion of the division wall, the bubbles are stagnated there.

Figure 4:
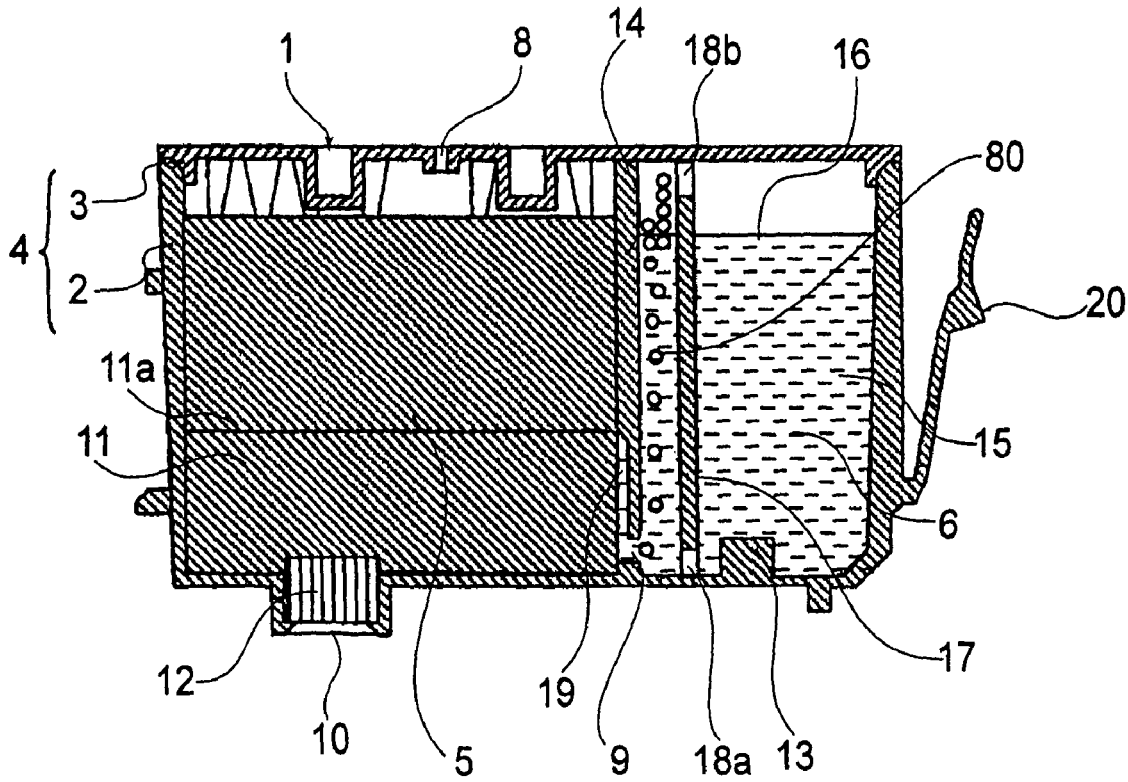
FIG. 4 is a sectional view illustrating an operation of the container according to the present invention.

Referring to FIG. 4, the behavior of the bubbles in the present invention will be described. Designated by reference numeral 80 are bubbles in this Figure. When the bubbles rise up toward the ink liquid surface, they stagnate immediately below the ink surface. With the lowering of the ink liquid surface with the consumption of the ink, the stagnating bubbles appear above the liquid surface and wait for vanishing. The effects of the division wall 17 and the upper opening 18*b* are greatest, when the ink is sufficiently contained in the ink accommodation chamber 6 including the middle chamber 7, and therefore, the liquid surface height is near to the upper opening 18*b*. With the lowering of the liquid surface, the effect of the division wall 17 becomes relatively greater.

Embodiment 2

Figure 5:
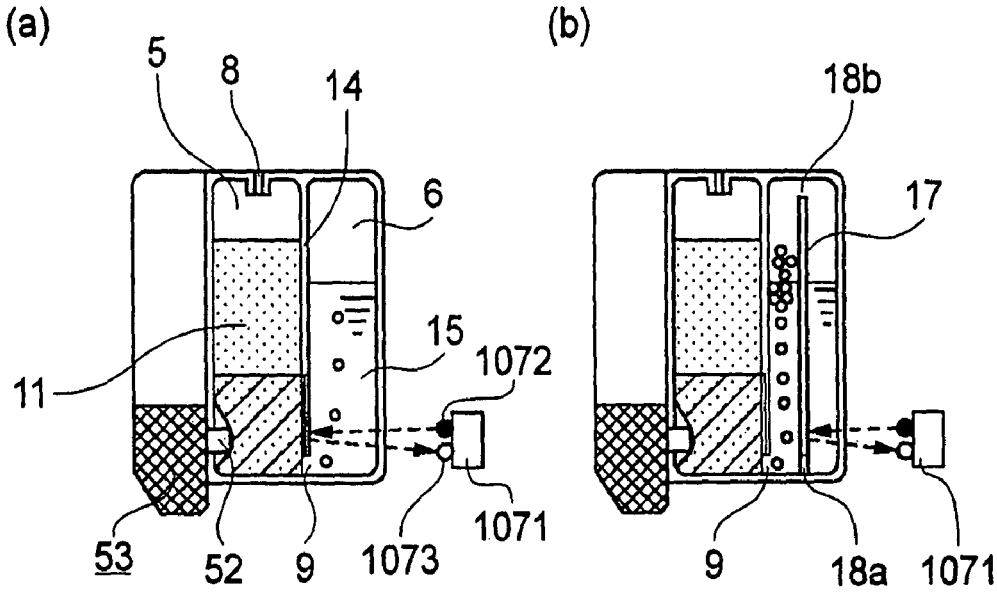
FIG. 5 is a schematic sectional view illustrating a container according to Embodiment 2 of the present invention.

FIG. 5, (*b*) is a substantial sectional view of an ink cartridge according to Embodiment 2 of the present invention, which is applied to an ink cartridge comprising integral recording head portion 53 and the ink container 50. FIG. 5, (*a*) shows a conventional ink cartridge.

The structure and operation of the right hand side of the ink supply tube 52 for connection between the recording head 53 and the ink container in the Figure, are the same as with Embodiment 1, and therefore, the detailed description thereof is omitted for simplicity, and the same reference numerals as with the foregoing embodiment are assigned to the elements having the corresponding functions.

In the conventional structure, as shown in FIG. 5, (*a*), a surface of the partition wall 14 is used as the optical reflection member, and an optical sensor 1071 is provided opposed to the partition wall 14. Infrared light from a light emitting portion 1072 of the optical sensor 1071 is once reflected and then returns to a light receiving portion 1073 of the optical sensor 1071. More particularly, the ink accommodation chamber 6 is made of transparent material, and the partition wall 14 is colored white to provide the reflecting surface. The remaining ink amount is detected using a light transmittance difference between the ink and the air.

This embodiment, as shown in FIG. 5, (*b*), the use is made with the surface of the division wall 17 which is colored white as the optical reflection member. By doing so, the bubbles resulting from the gas-liquid exchanging operation are present only at the rear side of the division wall 17, and therefore, there is no interference with the light for the optical sensor, so that erroneous detection of the remaining ink amount can be avoided.

Embodiment 3

Figure 6:
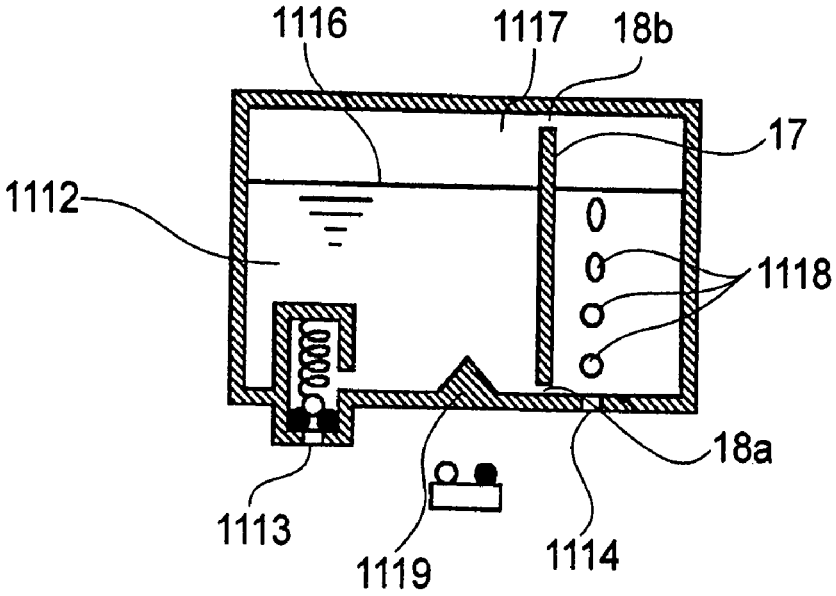
FIG. 6 is a schematic sectional view illustrating a container according to Embodiment 3 of the present invention.

FIG. 6 shows an ink container according to Embodiment 3 of the present invention, wherein the ink 1112 is directly accommodated in the container, and there is the air in an upper space 1117 of the container. The bottom surface of the container is provided with an ink supply port 1113 closed by a plug urged by an elastic member. The bottom portion of the ink container is provided with an air vent 1114 in the form of a fine opening for introduction of the ambient air. The diameter, the configuration and the ink property are such that meniscus force is provided to generate a negative pressure in the container. With supply of the ink 1112 from the ink supply port 1113 into the ink jet recording head (unshown), the gas-liquid interface 1116 lowers, and the bubble 1118 is introduced into the upper space 1117 through the air vent 1114.

The bottom portion of the ink container is provided with an optical reflection member 1119 for detecting the remaining ink amount.

Similarly to Embodiment 1 and Embodiment 2, in this embodiment, the division wall 17 for partitioning between the optical reflection member 1119 and the air vent 1114, and the upper portion thereof is provided with an opening 18*b*, and the lower portion thereof is provided with an opening 18*a*. The operation and the effects are similar to those in Embodiment 1 and Embodiment 2, and the description thereof is omitted for simplicity.

Figure 7:
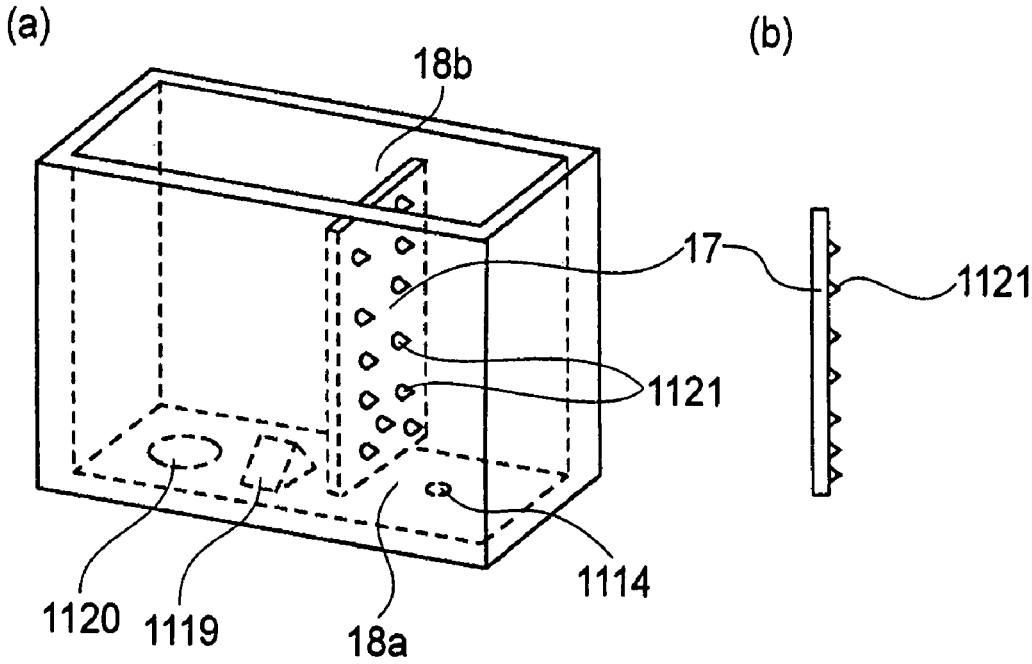
FIG. 7 is a perspective view illustrating a modified example, according to the present invention, of Embodiment 3.

In this embodiment, as shown in FIG. 7, the surface of the division wall 17 at the air vent side is provided with a plurality of projections 1121 in the form of shark teeth to provide the bubble trapping effect similarly to Embodiment 1 (FIG. 3, (*f*)). Thus, the auxiliary trapping effect to the rising bubble in the ink and the trapping effect to the bubbles stagnating in the neighborhood of the ink liquid surface are both provided, so that bubbles move to the opposite side of the division wall 17 through the 20 upper portion opening 18*b*, and therefore, the lowering of the bubbles with the ink liquid surface can be impeded. Since the great effect is provided by the division wall 17 and the upper opening 18*b*, the projections 1121 may be provided on the optical reflection member side of the division wall 17 in consideration of the event that the bubbles move to the opposite side of the division wall 17 through the upper portion opening 18*b*.

Other Embodiments

Figure 8:
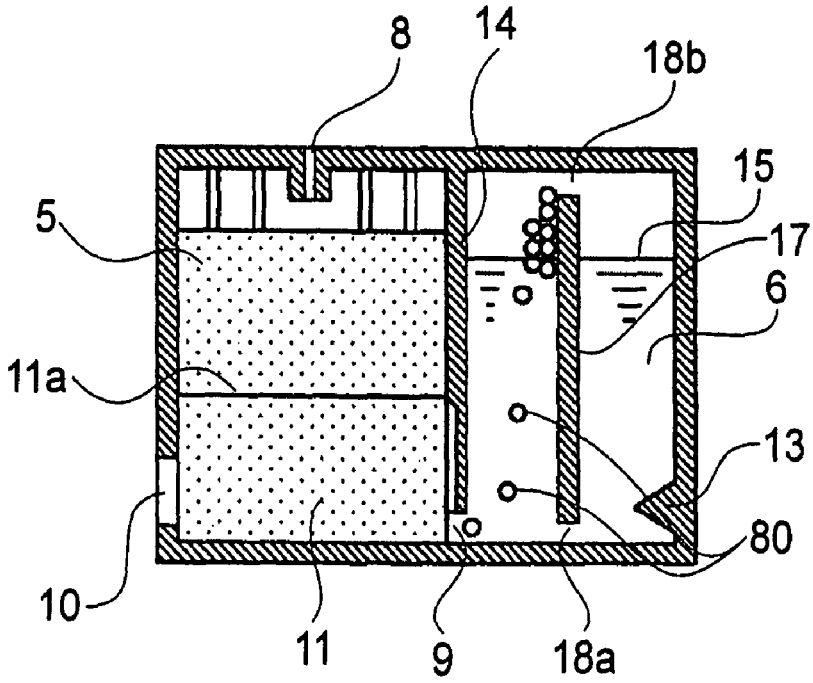
FIG. 8 is a schematic sectional view illustrating another embodiment of the present invention.
Figure 9:
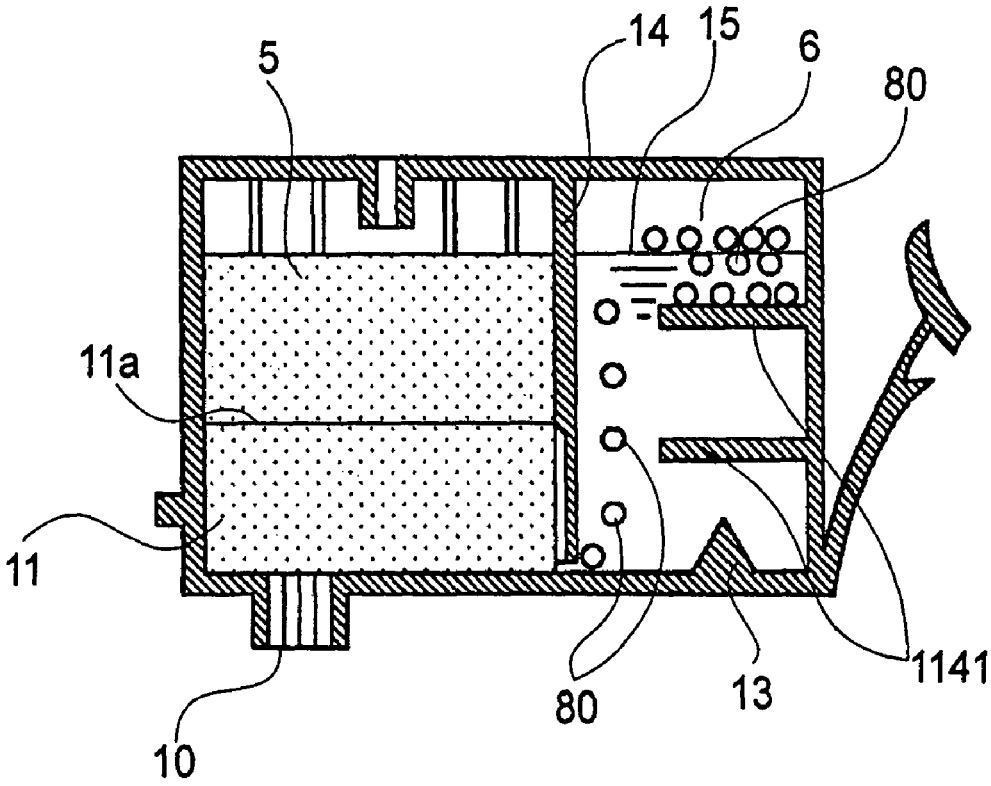
FIG. 9 is a schematic sectional view illustrating a further embodiment of the present invention.
Figure 10:
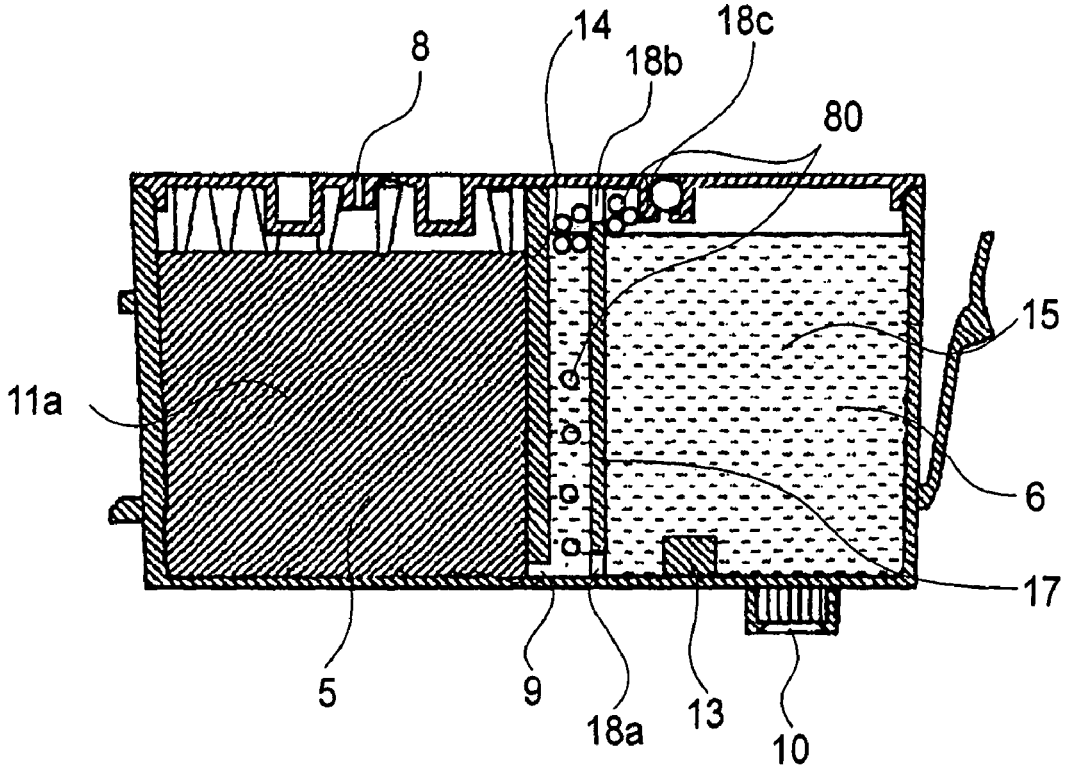
FIG. 10 is a schematic sectional view illustrating a further embodiment of the present invention.
Figure 11:
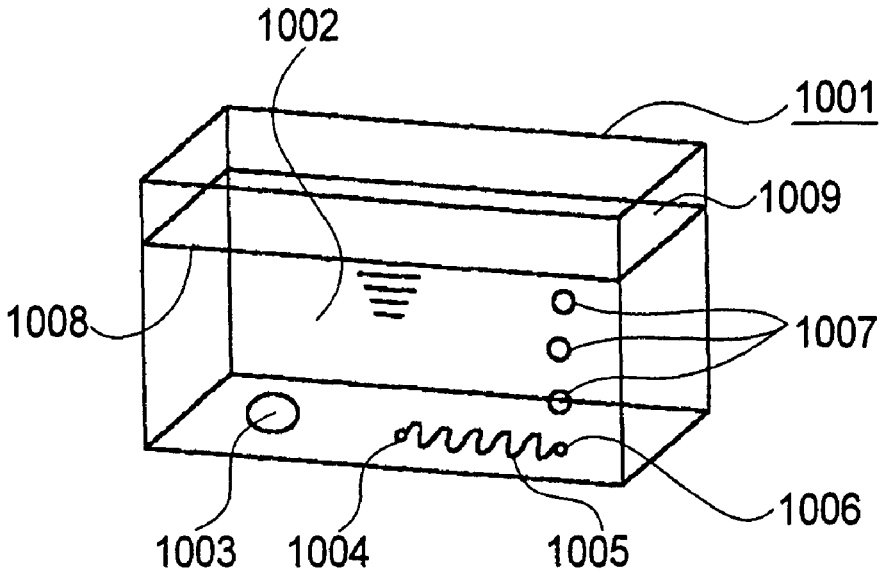
FIG. 11 shows a conventional ink container.
Figure 12:
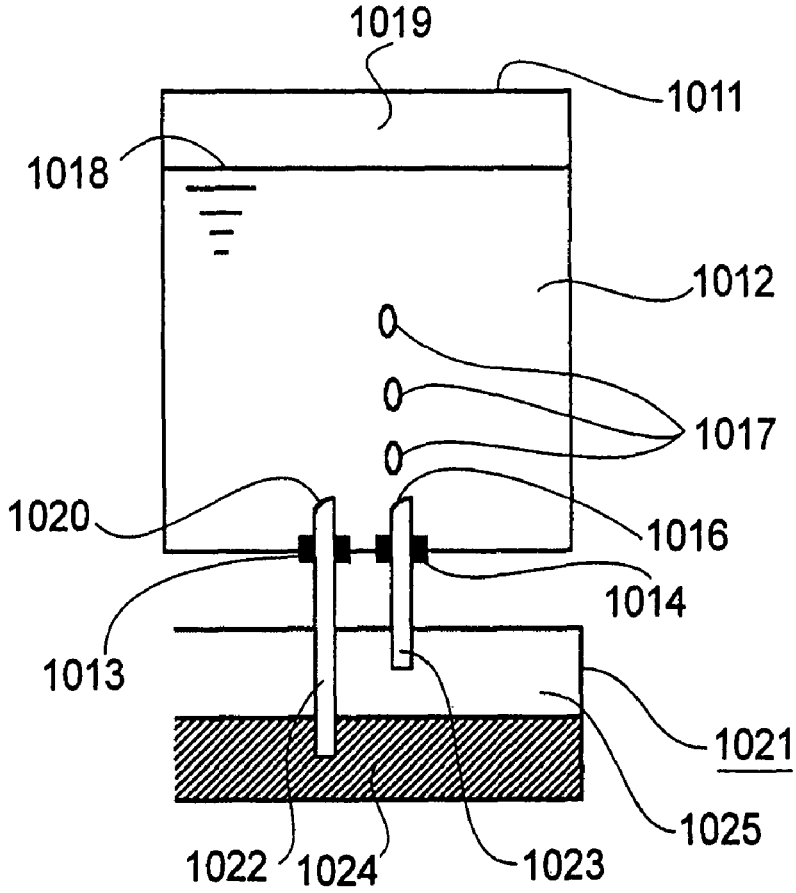
FIG. 12 shows a conventional ink container.
Figure 13:
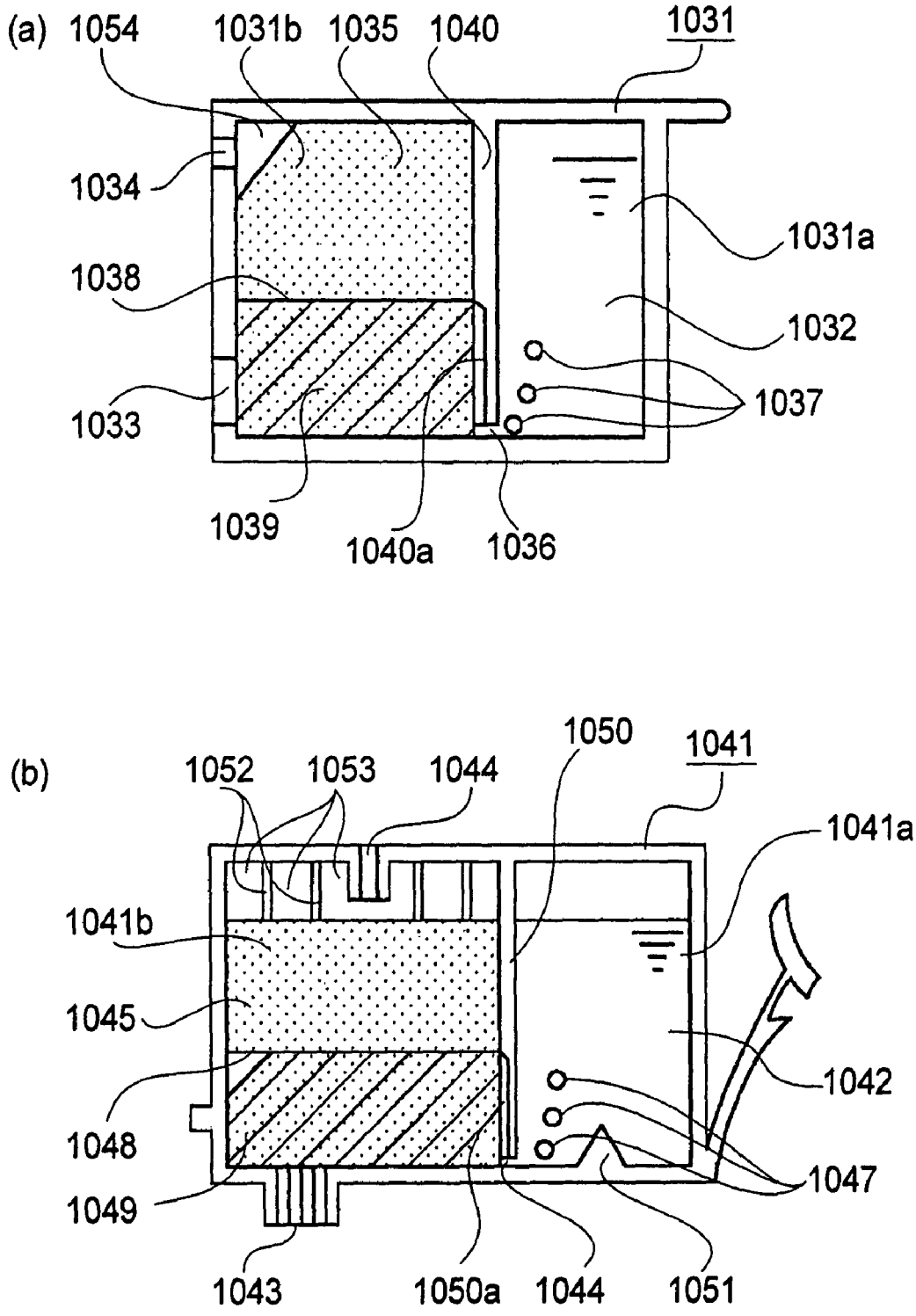
FIG. 13 shows a conventional ink container.
Figure 14:
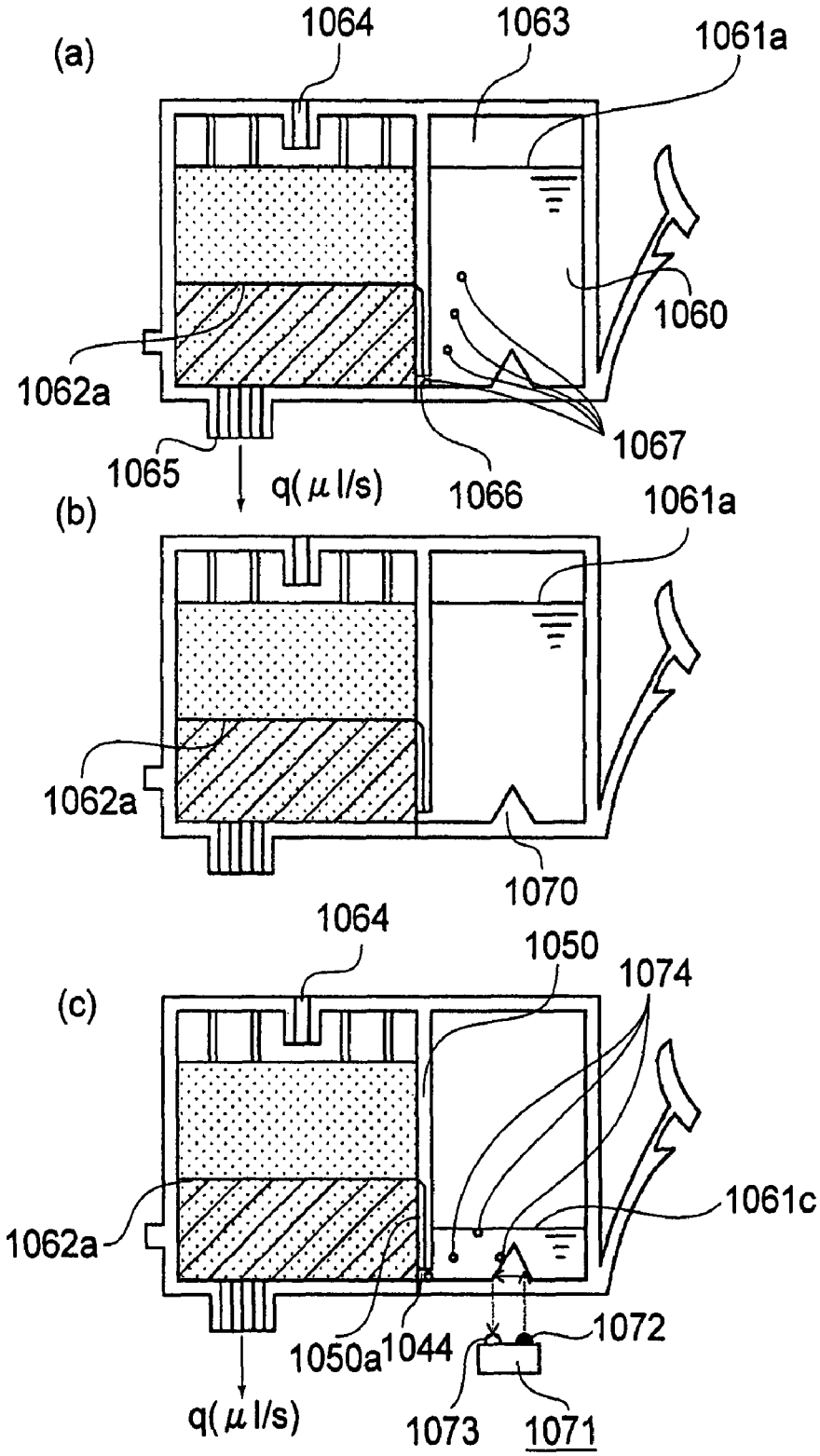
FIG. 14 shows a conventional ink container.
Figure 15:
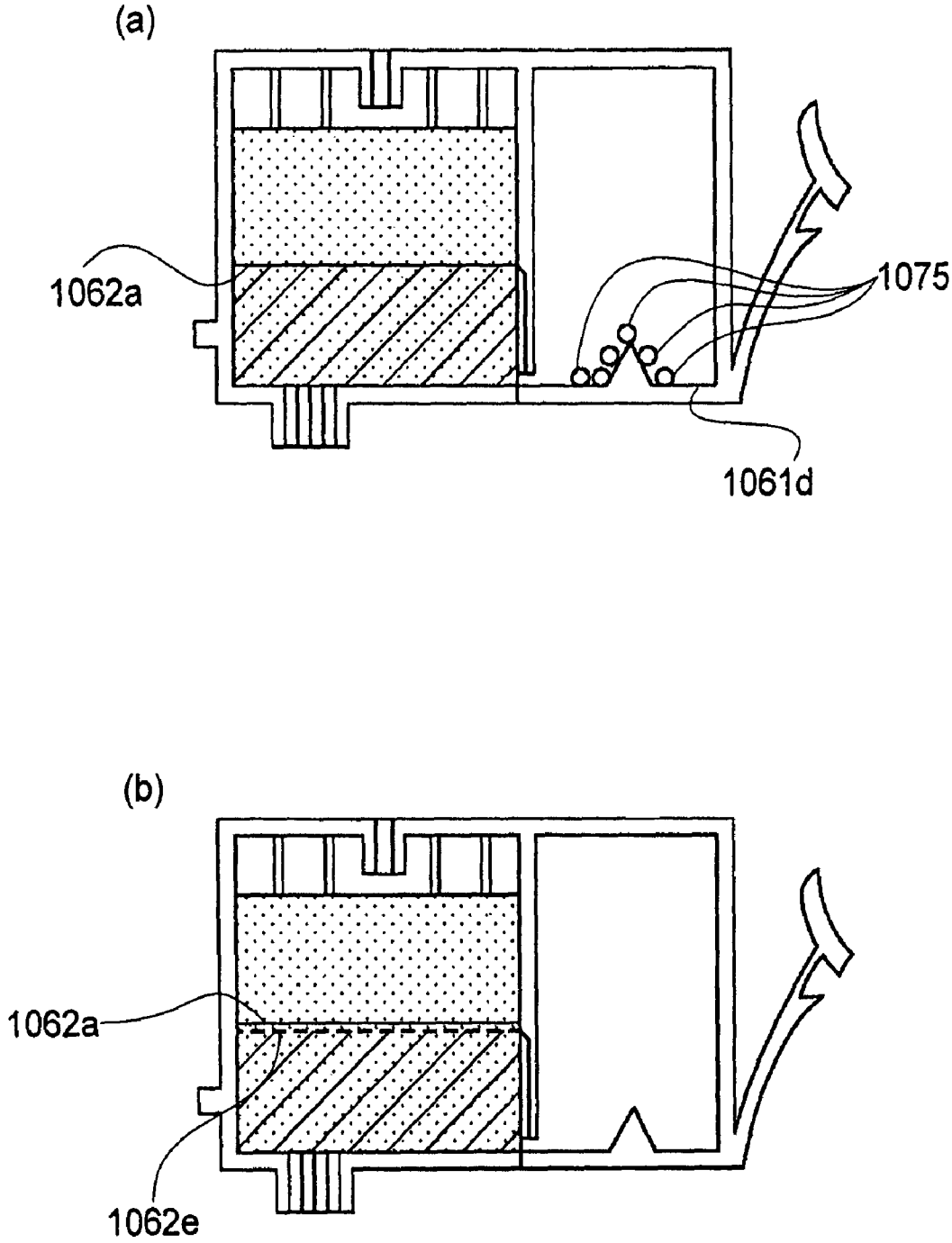
FIG. 15 illustrates normal operation of a conventional ink container.
Figure 16:
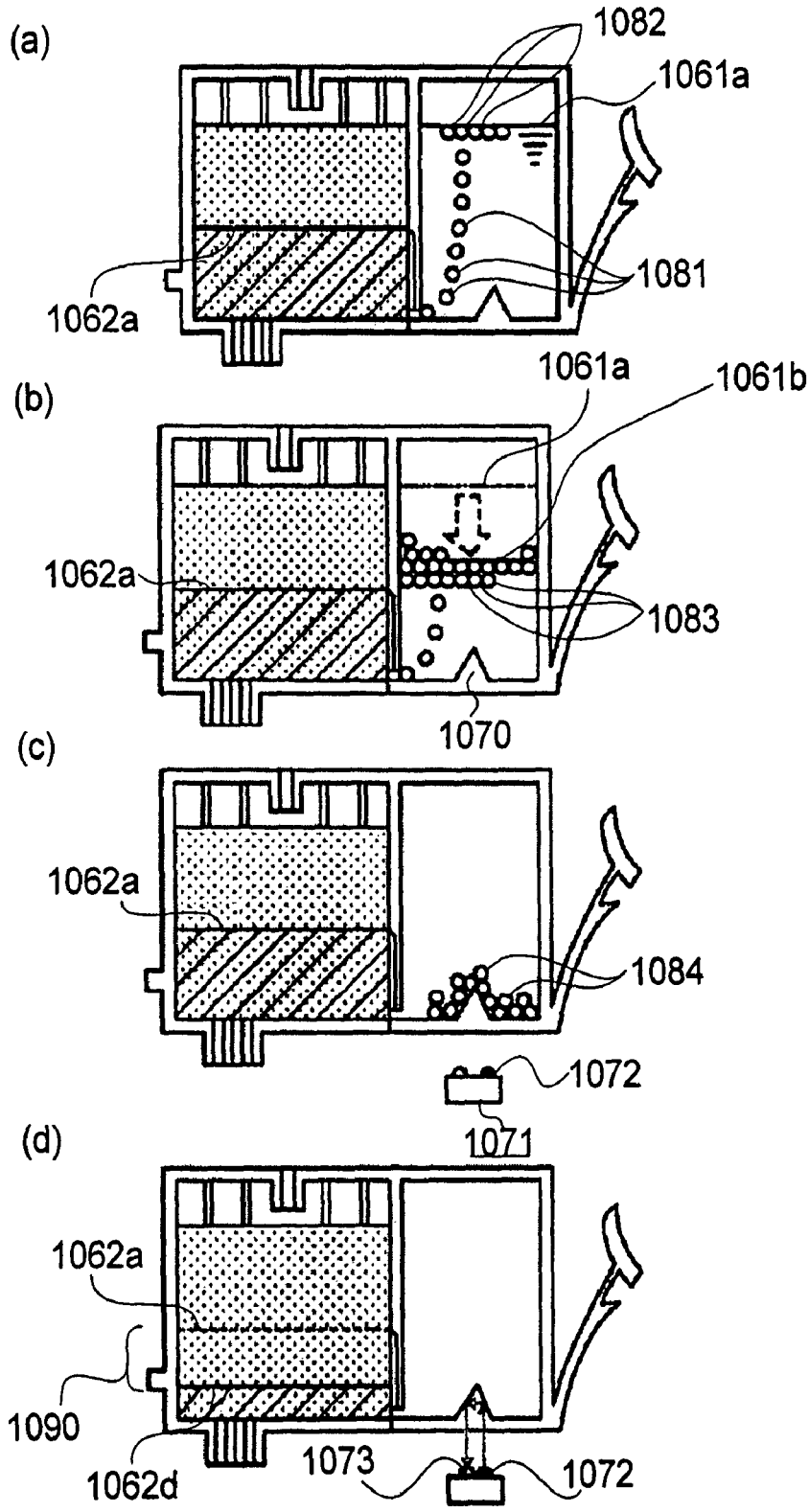
FIG. 16 illustrates a problem with a conventional ink container.
Figure 17:
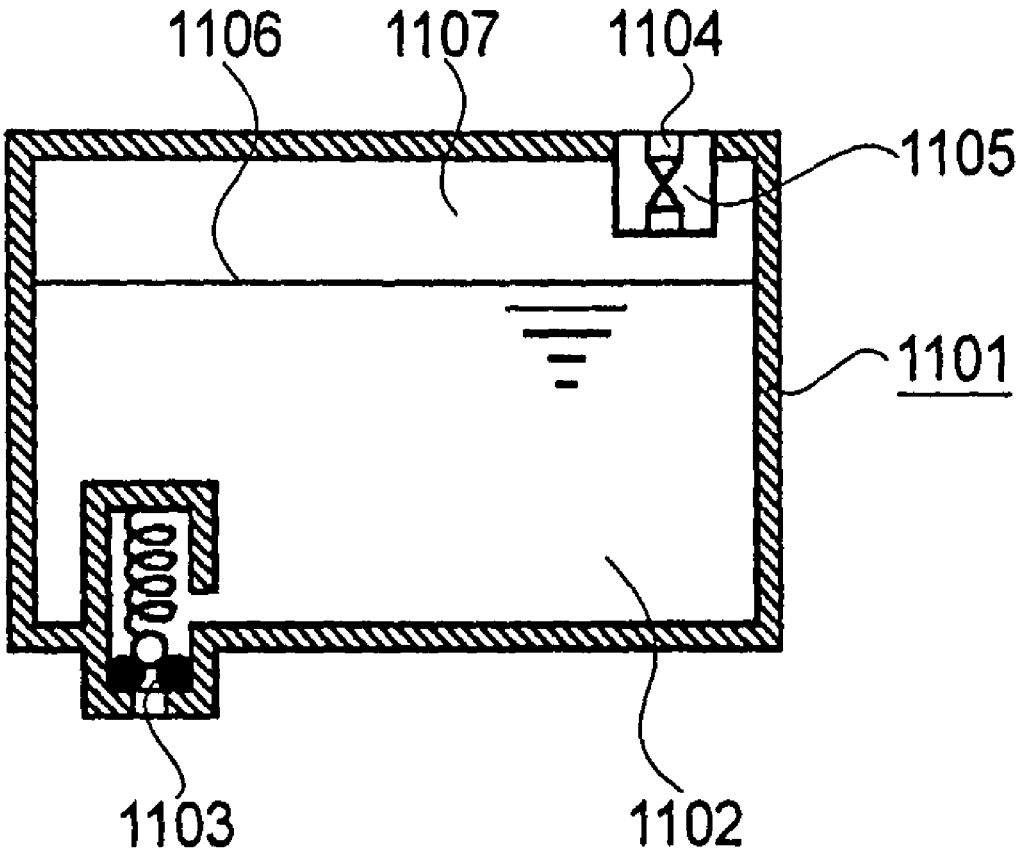
FIG. 17 shows an ink container which is free of the problem underlying the present invention.

FIG. 8-FIG. 10 show other embodiments of the present invention, wherein the same reference numerals as in Embodiment 1 are assigned to the elements having the corresponding functions in this embodiment, and the detailed description thereof is omitted for simplicity.

In the ink container shown in FIG. 8, the optical reflection member 13 is disposed on an inner side of the ink accommodation chamber 6 which is opposed to the partition wall 14. By the provision of the division wall 17 for partitioning between the fluid communication path 9 side of the partition wall 14 and the optical reflection member 13, the similar functions and effects as Embodiment 1 and Embodiment 2 are provided.

The ink container shown in FIG. 9 comprises a plurality of wall 1141 projected from an inner side surface opposed to the partition wall 14 of the ink accommodation chamber 6 in a direction substantially parallel with the bottom surface of the ink accommodation chamber, such that they are disposed above the optical reflection member 13 provision on the bottom surface of the ink accommodation chamber 6. With this structure, when the bubbles stagnating at the ink liquid surface of the ink accommodation chamber as a result of the gas-liquid exchanging operation lowers with the ink liquid surface in accordance with consumption of the ink, the bubbles are trapped by the multi-stages of the walls 1141, so as to prevent the bubbles from reaching the optical reflection member 13.

The operation principle of the ink container shown in FIG. 10 is different from that of Embodiment 1.

More particularly, referring still to FIG. 10, the bottom portion of the ink accommodation chamber 6 is provided with an ink supply port 10. A partition wall 14 partitions the ink container into the ink accommodation chamber 6 and a negative pressure generating member accommodating chamber 5 which accommodates a negative pressure generating member 11 and which is provided with an air vent 8, and the two chambers are in fluid communication with each other through a fine fluid communication path 9 provided at a lower portion of the partition wall 14. The bottom surface of the ink accommodation chamber 6 is provided with an optical reflection member 13, and the division wall 17 having an upper portion opening 18*b* and a lower portion opening 18*a* is provided between the partition wall 14 having the fine fluid communication path 9 and the optical reflection member 13.

When the ink is supplied into the ink jet recording head, the ink 15 accommodated in the negative pressure generating member accommodating chamber 5 is consumed. After the ink in the negative pressure generating member accommodating chamber 5 is consumed up, the bubbles are introduced into the ink accommodation chamber 6 through the fine fluid communication path 9. The negative pressure is produced by the meniscus force at the fine fluid communication path 9, and after the consumption of the ink, the negative pressure generating member accommodating chamber 11 functions as a buffer space for preventing the ink in the ink accommodation chamber 6 from overflowing due to the air expansion contraction under changes of the ambient temperature and/or pressure.

In such an ink container, the malfunction of the remaining amount detection attributable to the bubbles introduced into the ink, is effectively prevented by the division wall 17, the opening 18*b*, and in this embodiment, by the opening for injecting the ink into the ink accommodation chamber and the sealing plug portion 18*c* for the opening. The structures disclosed in FIG. 3 or FIG. 7 are also usable in this embodiment.

In the foregoing, the description has been made with respect to the examples wherein the optical reflection member is provided in the ink container, but there is another detector such as a detector of an electrostatic capacity type or a detector using an acoustic property, which is also influenced by deposition of the bubbles to such an extent of erroneous detection of the remaining amount. The present invention is applicable also to such a sensor.

In addition, in the foregoing description, the division wall 17 is extended substantially vertically in use or in parallel with the partition wall 14. This is preferable from the standpoint of easy manufacturing, because then an inner mold can be removed easily from the open top of the container (before capping) however, the present invention is not limited to such an example, and the division wall may extend inclined or curved toward or away from the partition wall to such an extent that the above-described advantageous effects of the present invention, namely, including the bubble guiding function and/or the bubble stagnating function.

As described in the foregoing, according to the embodiments of the present invention, there is provided an ink container wherein the ambient air is introduced into the ink accommodation chamber through the ink, and wherein the bubbles produced by the introduction of the ambient air are prevented from approaching the optical reflection member by the provision of the division wall, and the bubbles are directed upward toward the ink liquid surface away from the optical reflection member, and in addition, the structures for stagnating the bubbles to provide long time for bubble vanishing are effective to prevent the erroneous detection of the remaining amount attributable to the bubbles surrounding the optical reflection member, provided in the ink accommodation chamber, for detecting the remaining ink amount.

While the invention has been described with reference to the structures disclosed herein, it is not confined to the details set forth and this application is intended to cover such modifications or changes as may come within the purpose of the improvements or the scope of the following claims.

This application claims convention priority from Japanese Patent Application No. 164547/2004 filed Jun. 2, 2004, which is hereby incorporated by reference.

What is claimed is:

1. An ink container containing ink to be supplied to an ink jet head, said container comprising:

a casing; and a first wall partitioning the casing into first and second chambers and having one end which defines a communicating portion between the first and second chambers, wherein the first chamber constitutes an absorbing material accommodating chamber accommodating an absorbing material therein, and is provided with an air vent for fluid communication with ambient air and an ink supplying portion for supplying the ink to the ink jet head, wherein the second chamber constitutes an ink reservoir chamber directly accommodating the ink and is provided with a prism member for optically detecting an amount of the ink in said ink reservoir chamber, wherein the ink reservoir chamber is further provided with a second wall for partitioning between the first wall and the prism member, wherein opposite ends of the second wall define respective communication openings for fluid communication between one side and other sides of the ink reservoir chamber, and wherein the second wall is arranged to suppress direct reaching, to the prism member, of a bubble which moves from the absorbing material accommodating chamber into the ink reservoir chamber through the communicating portion when the ink moves from the ink reservoir chamber into said absorbing material accommodating chamber through said communicating portion to supply the ink from the ink container to the ink jet head.

2. An ink container according to claim 1, wherein the second wall is so remote from the first wall as not to prevent rising of the bubble moved from the absorbing material accommodating chamber into the ink reservoir chamber.

3. An ink container according to claim 2, wherein the second wall extends to a position near a top inner wall of the ink reservoir chamber.

* * * * *